US005127767A

United States Patent [19]

Plagborg-Moller

[11] Patent Number: 5,127,767

[45] Date of Patent: Jul. 7, 1992

[54] METHOD AND A DEVICE FOR MOUNTING THE PILES ASSOCIATED WITH THE INSTALLATION OF A PILE-FOUNDED OFFSHORE PLATFORM

[75] Inventor: Jakob Plagborg-Møller, Vedbæk, Denmark

[73] Assignee: Maersk Olie Og Gas A/S, Copenhagen, Denmark

[21] Appl. No.: 720,434

[22] PCT Filed: Jan. 10, 1990

[86] PCT No.: PCT/DK90/00008

§ 371 Date: Aug. 6, 1991

§ 102(e) Date: Aug. 6, 1991

[87] PCT Pub. No.: WO90/08232

PCT Pub. Date: Jul. 26, 1990

[30] Foreign Application Priority Data

Jan. 11, 1989 [DK] Denmark ..... 0112/89

[51] Int. Cl.[5] ..... E02B 17/02

[52] U.S. Cl. ..... 405/227; 405/228

[58] Field of Search ..... 405/195, 224, 227, 228, 405/232; 166/341

[56] References Cited

U.S. PATENT DOCUMENTS

| | | | |
|---|---|---|---|
| 3,483,708 | 12/1969 | Marshall . | |
| 3,670,507 | 6/1972 | Mott et al. | 405/227 |
| 3,751,930 | 8/1973 | Mott et al. | 405/227 X |
| 4,069,683 | 1/1978 | Jansz | 405/227 |
| 4,720,214 | 1/1988 | Brasted et al. | 405/227 |

FOREIGN PATENT DOCUMENTS 1501583 2/1978 United Kingdom .

*Primary Examiner*—David H. Corbin
*Attorney, Agent, or Firm*—Ladas & Parry

[57] ABSTRACT

A method serves to mount the piles (6) associated with the installation of a pile-founded offshore platform, e,g, a production platform, wherein these are driven down into the sea bed through pile guides (12) attached to or forming part of the foundation (16) of the platform. A device for performing the method comprises at least one chute (15) which is preferably C- or U-shaped in cross section and which extends with a suitable inclination upwardly from the upper end (13) of a pile guide (12) to at any rate substantially in below the position which the pile tip (8) of a pile (6) to be placed in the pile guide (12) assumes in said freely hanging position of the pile (6). A conventional drilling rig may be used for installation of in particular smaller platforms, thus providing great savings in terms of economy and frequently also in terms of time.

12 Claims, 6 Drawing Sheets

METHOD AND A DEVICE FOR MOUNTING THE PILES ASSOCIATED WITH THE INSTALLATION OF A PILE-FOUNDED OFFSHORE PLATFORM

The invention concerns a method of mounting the piles associated with the installation of a pile-founded off-shore platform, e.g. a production platform, wherein these are driven down into the sea bed through pile guide attached to the foundation of the platform.

Platforms of this type have previously been installed by means of very large floating cranes which serve to submerge the platform which has been transported to the drilling location on a barge, to position the foundation piles in the guides of the platform and to lift the drive means, e.g. a hammer or a vibrator for driving the piles into the sea bed. Only few of these special cranes are available in the world, and to this should be added that they are extremely expensive to rent and use, and this entails that there may be undesirably long waits when a platform is to be installed, and that the installation costs will be excessively high in particular for smaller platforms.

The object of the invention is to provide a method of the type stated in the opening paragraph, by which in particular smaller platforms may be installed at much lower costs than in the past and without having to await the arrival of a special floating crane.

This is obtained in that the method of the invention is characterized in that the piles are hoisted one by one with the pile head uppermost by means of a winch which is arranged in or in connection with the derrick on a drilling rig, positioned at the drilling location, to a suitable location above the platform, where the pile preferably hangs freely in the wire of the winch with a smaller distance to the central axis of the platform than the upper end of the associated pile guide, and that the pile is then lowered, with its tip being initially guided obliquely outwardly and downwardly away from the central axis of the foundation towards the upper end of the pile guide during said movement until it extends into said end, following which the pile continues down through the pile guide to the sea bed and is finally driven down to the desired depth in said bed by a drive means which is suspended from the wire of the winch, and whose preferably lower end is initially guided obliquely inwardly and upwardly towards the central axis of the foundation during the subsequent hoisting of the drive means until the drive means hangs freely downwardly in the vertical of the wire. Thus, it is possible to install in particular smaller platforms by means of a conventional drilling rig for drilling wells. Usually, such a drilling rig is present at the drilling location or not far from it, and since this drilling rig is much cheaper to operate than the above mentioned very big floating cranes, both waiting time and large crane renting costs are saved.

In a particular simple and expedient embodiment of the method of the invention the pile tip is initially guided obliquely outwardly and downwardly towards the upper end of the pile guide during lowering of the pile until it extends into said end, the tip being slidably guided along a chute which is preferably C- or U-shaped in cross section and extends with a suitable inclination upwardly from the upper end of the pile guide to a location at any rate substantially below the position which the pile tip assumes in said freely hanging position of the pile.

Further, in the method of the invention, a drive means for driving the pile down in the sea bed e.g. by repeated blows or vibrations is hoisted by means of the winch of the derrick to a suitable position which is substantially vertical above the pile head of the pile to be driven down, and the drive means is then lowered to engage the pile head and drive down the pile to the desired depth in the sea bed, following which the drive means is hoisted again and preferably its lower end is initially guided slidingly up the chute during said movement until the drive means hangs freely downwardly in the vertical of the wire. The drilling rig may thus also be used for driving down the piles, without this entailing that the drive means, which may e.g. be a hammer having a length of 16–8 m and a weight of 300–500 tons, will swing violently and dangerously when it is disengaged from the pile head on the pile driven down.

The invention also concerns a device for performing the method described above for mounting the piles associated with the installation of a pile-founded offshore platform, e.g. a production platform, wherein these are driven down into the sea bed through pile guides attached to the foundation of the platform, and according to the invention this device is characterized in that it comprises a winch which is arranged in or in connection with a derrick on a drilling rig, positioned at the drilling location, for hoisting the piles one by one with the pile head uppermost to a suitable location above the platform, where the pile preferably hangs freely in the wire of the winch with a smaller distance to the central axis of the platform than the upper end of the associated pile guide and thereafter lowering the pile to the sea bed, and drive means which is suspended in the wire of the winch for driving the pile down in the sea bed, wherein the device further comprises at least one chute for guiding obliquely the pile and the drive means, respectively, which is preferably C- or U-shaped in cross section and extends with a suitable inclination upwardly from the upper end of the pile guide to a location at any rate substantially below the position which the pile tip of a pile to be positioned in the pile guide assumes in said freely hanging position of the pile. This provides an extremely effective and also simple and inexpensive structure which can be manufactured on shore in connection with the building of the platform.

According to the invention, the chute may be positioned with an angle of inclination with respect to a horizontal plane of between 20° and 70°, preferably between 40° and 60°, and in particular between 45° and 55°. The pile tip can then automatically, i.e. by gravity alone, slide down the chute until it reaches the upper end of the guide.

Moreover, according to the invention, the chute may be firmly mounted on the platform, thus providing cost savings in connection with the installation since all chutes. are directly present in the correct installation position as soon as the platform has been positioned on the sea bed, but the chute may also be so adapted as to be detachably mountable on the platform, so that the chute may be used repeatedly for mounting many piles, and finally the chute may be mounted on another structure disposed at the platform, e.g. The drilling rig itself, so that the method of the invention may also be used for installation of platforms which are not equipped with chutes.

The invention will be explained more fully below with reference to the drawing, in which FIGS. 1-8 show the sequence of the individual operational steps which are associated with the installation of a platform by means of the method of the invention.

Figure 1:
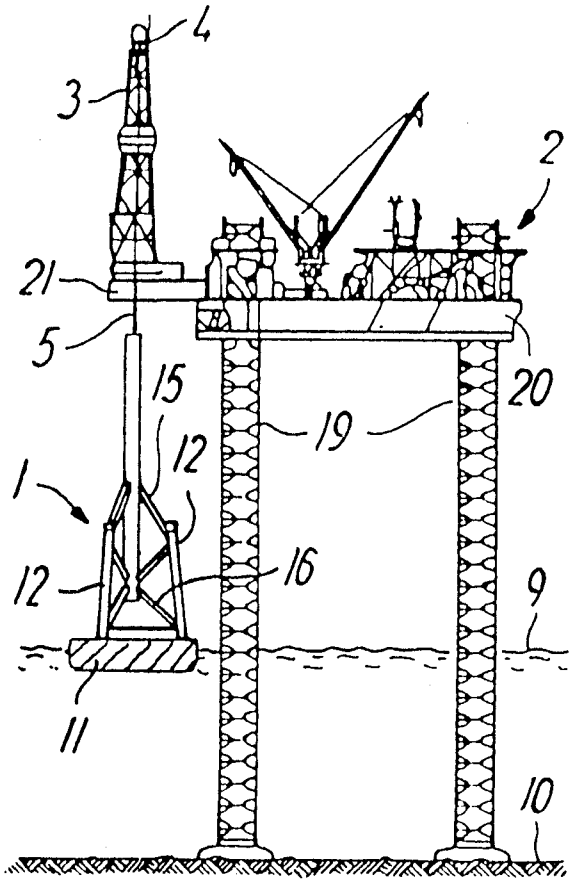

FIGS. 1-8 show schematically how a platform, generally indicated by the reference numeral 1, is successively installed by means of a drilling rig, generally indicated by the reference numeral 2. The drilling rig 2 is typically provided with three or four legs 19, only two of which are shown in FIG. 1 and one in FIGS. 2-8 which just show the front portion of the drilling rig. The drilling rig has moreover a drilling floor 20, which can float on the water, with the legs 19 raised. When the drilling rig operates, the legs 19 are lowered as shown so that the drilling rig 2 stands on the sea bed with the floor lifted above the surface of the sea 9. A derrick 3, which stands on a drilling floor section 21 cantilevered over the drilling location, serves to drill one or more wells at the drilling location in a known manner. To this end, a winch 4 having a lifting wire 5 is positioned in the derrick 3 or in connection with it, and this winch has such a great lifting capacity that it is capable of lifting smaller platforms, typically with a weight much below 1000 tons, e.g. via a suitable transmission.

Figure 2:
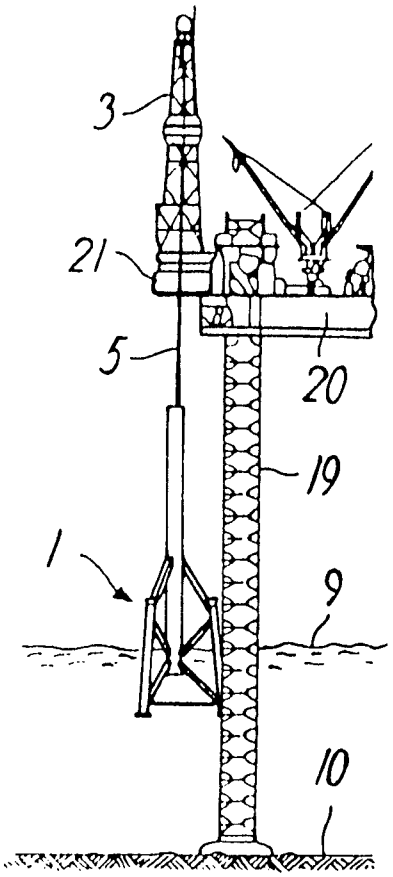
Figure 3:
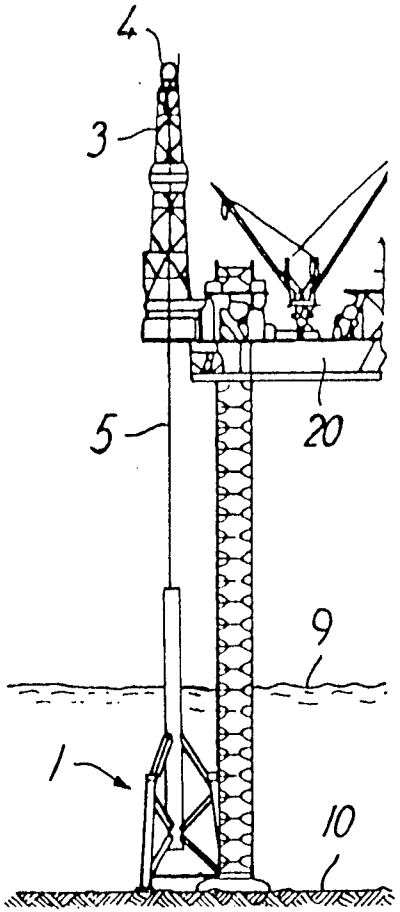

The platform 1 shown by way of example in FIGS. 1-8 is such a smaller platform which may thus be lifted by means of the winch. In FIG. 1, the platform has been transported to a location below the derrick 3 on a barge 11 and secured with the wire 5. In FIG. 2 the barge 11 has been pulled away, and the platform now hanging in the wire 5 has been lowered a distance below the sea surface 9. In FIG. 3, the platform 1 has finally been positioned on the sea bed 10, and then the foundation piles are to be mounted.

Figure 4:
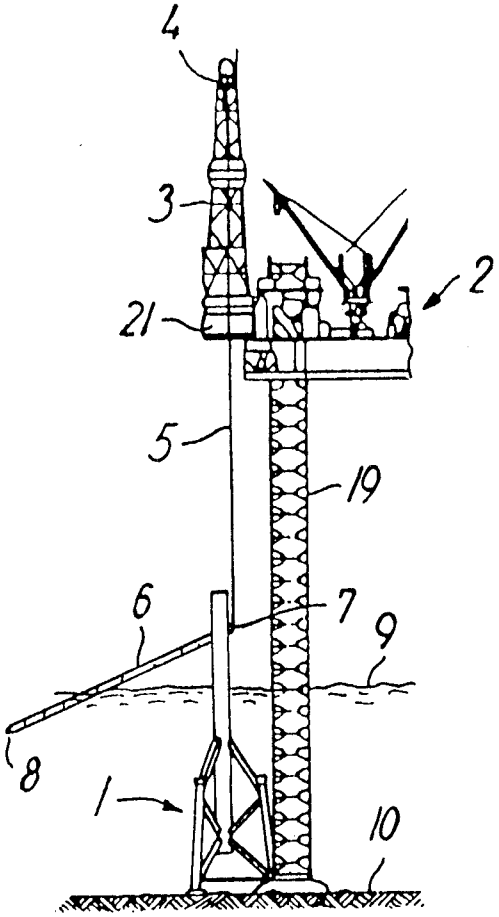

These piles have been transported together with the platform on the same barge or for example separately on another barge. FIG. 4 shows a pile 6 which is secured at the pile head 7 and lifted somewhat upwardly In FIG. 5, the pile hangs freely in the wire above the platform and is then to be inserted into the pile guide 12, which is secured to or forms part of the foundation 16 of the platform. The cantilevered floor section 21 of the drilling rig 2 has a limited horizontal extent with a width of e.g. about 8 m and a cantilever of e.g. about 13 m, and this is sufficient for the derrick to be positioned correctly over the drilling location when the derrick is used for drilling wells, but not sufficient to make the pile 6 hang vertically down over the upper end 13 of the guide 12 into which the pile is to be inserted, since, for stability, the piles must be positioned with such a great mutual distance that they will stand considerably outside the operational area of the derrick.

Figure 6:
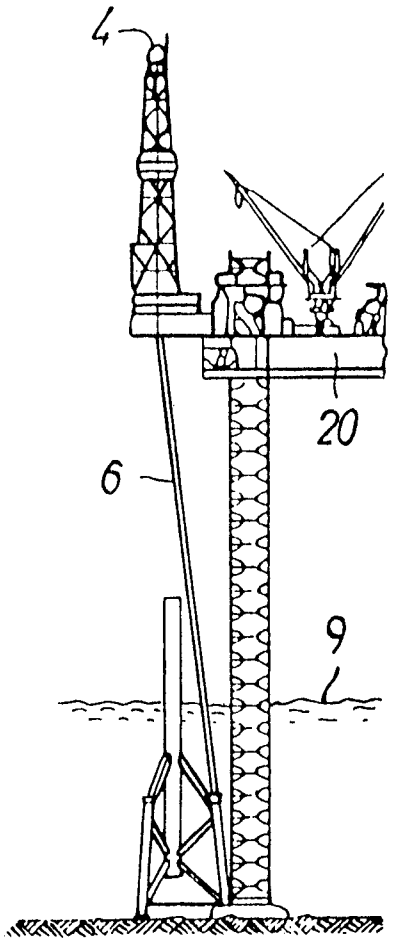
Figure 5:
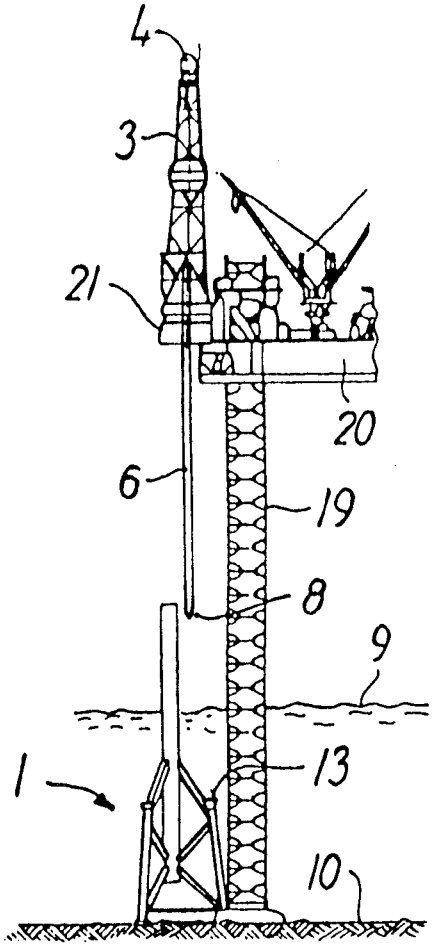

Therefore, the pile tip 8 is forcibly guided according to the invention past this operational area in such a manner than the pile tip finally extends into the upper end 13 of the guide 12 during lowering of the pile 6. This is shown in FIG. 6 where the pile hangs obliquely downly from the wire 5 with the pile head 7 within the operational area of the derrick and the tip 8 inserted into the upper end 13 of the guide 12 outside this operational area.

Figure 10:
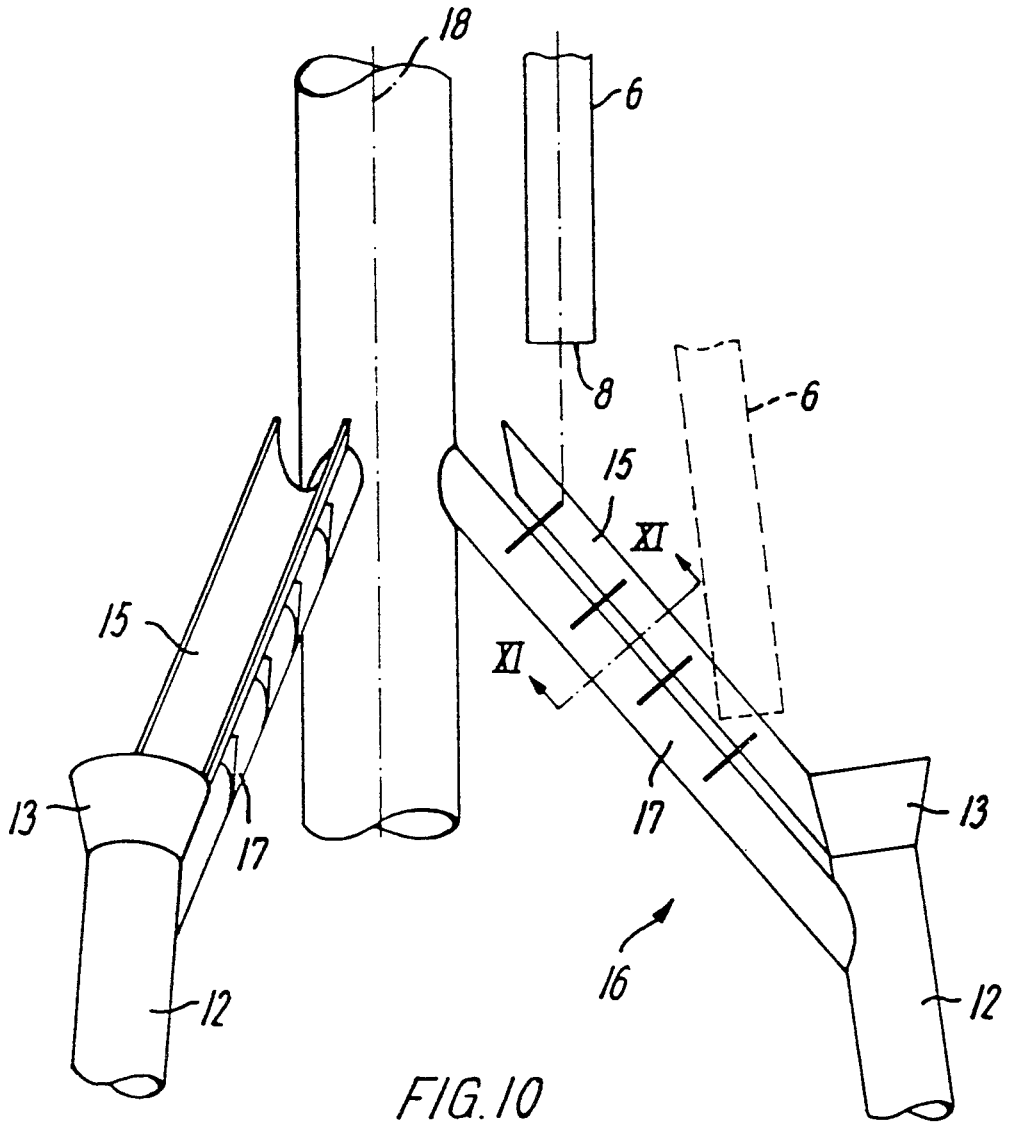
FIG. 10 is an enlarged lateral view of a part of the platform shown in FIG. 9, each chute being mounted on a stiffening pipe.
Figure 11:
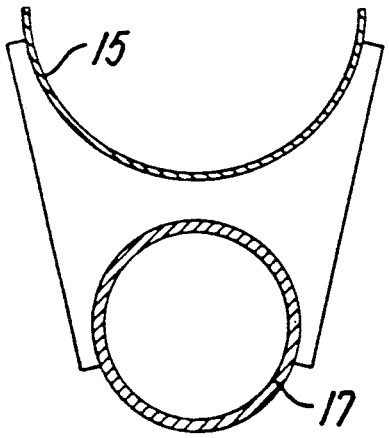
FIG. 11 is a section on an even larger scale along the line XI—XI in FIG. 10 through the chute and the stiffening pipe.
Figure 12:
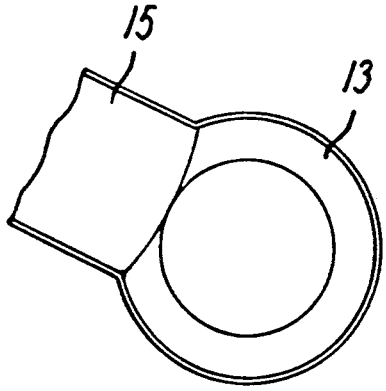
FIG. 12 is a top view of a detail of the connection between the chutes and the upper end of the guide.

FIGS. 10, 11 and 12 show a preferred embodiment of a device suitable for this operation, said device comprising chutes 15 which each are mounted on a stiffening pipe 17 of the platform foundation 16 in the shown example, and which extend obliquely upwardly from the upper end 13 of the pile guide 12 and inwardly below and a suitable distance past the position which the pile tip 8 assumes before lowering of the pile is initiated.

When the pile 6 is lowered, its tip 8 first touches the bottom of the chute 15, which, as shown best in FIG. 11, is C-shaped in cross section; however, the chute may equally well be U-shaped, V-shaped or have any other suitable cross sectional shape, the essential point being that the pile tip is secured against moving transversely to the chute once it is in contact with the bottom of said chute.

As shown in FIG. 10, the chute is positioned under a suitable angle of inclination with respect to a horizontal plane, and this angle of inclination may be between 20° and 70°, preferably between 40° and 60°, and in particular between 45° and 55°, and this entails that the pile tip slides down the chute as indicated by the dotted line in FIG. 10, until it arrives at the upper end 13 of the pile guide which, as shown in FIGS. 10 and 12, expands upwardly for better accommodation of the pile tip. During continued lowering of the pile, the pile will therefore continue down through the pile guide 12 until it stands on the sea bed, and then the wire is released from the pile head. As will be seen from FIG. 10 the pile guide is likewise inclined with respect to the central axis of the platform at an angle which may suitably be between 6° and 12°, so that the pile head is still present within the operational area of the derrick, although the pile guide is placed far beyond this area.

Figure 8:
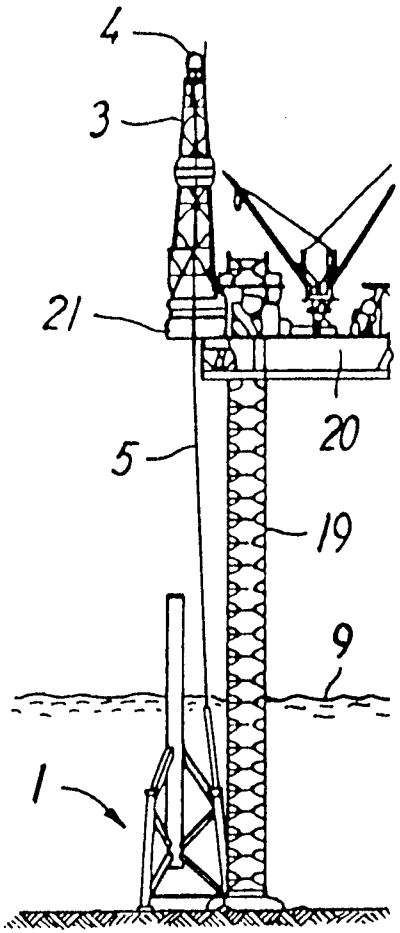
Figure 7:
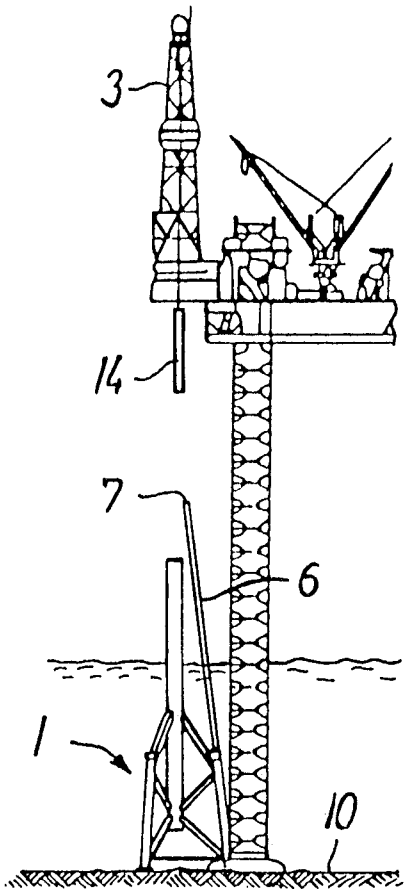

The pile is now to be driven into the sea bed, e.g. by repeated blows or vibrations, with a suitable drive means which is suspended from the wire 5 of the winch 4. In FIG. 7, the drive means 7 is hoisted above the platform 1 and positioned essentially vertically over the pile head 7, which, as mentioned above, is present within the operational area of the derrick 3. When the drive means 14 is lowered, it will therefore engage the pile head 7, and then the pile is driven down to the desired depth in the sea bed 10 by activation of the drive means 14. When the pile is being driven down, the drive means 14 is moved outside the operational area of the derrick by the pile head 7 and therefore hangs obliquely in the wire 5, as shown in FIG. 8. When the drive means releases the pile head in this position, it may therefore swing violently, which may be very dangerous and destructive considering that a drive means, such as a hammer, may typically have a length of 16-18 m and a weight of 300-500 tons.

When the drive means 14 is hoisted, its lower end is therefore preferably initially guided obliquely inwardly and upwardly according to the invention, until the drive means hang freely downwardly in the vertical of the wire where it is present in a natural state of balance. In a preferred embodiment of the method of the invention this takes place in that the lower end of the drive means is guided slidingly up the same chute 15 as was used for guiding the pile tip 8 into the upper end 13 of the pile guide 12, but in the opposite direction.

Figure 9:
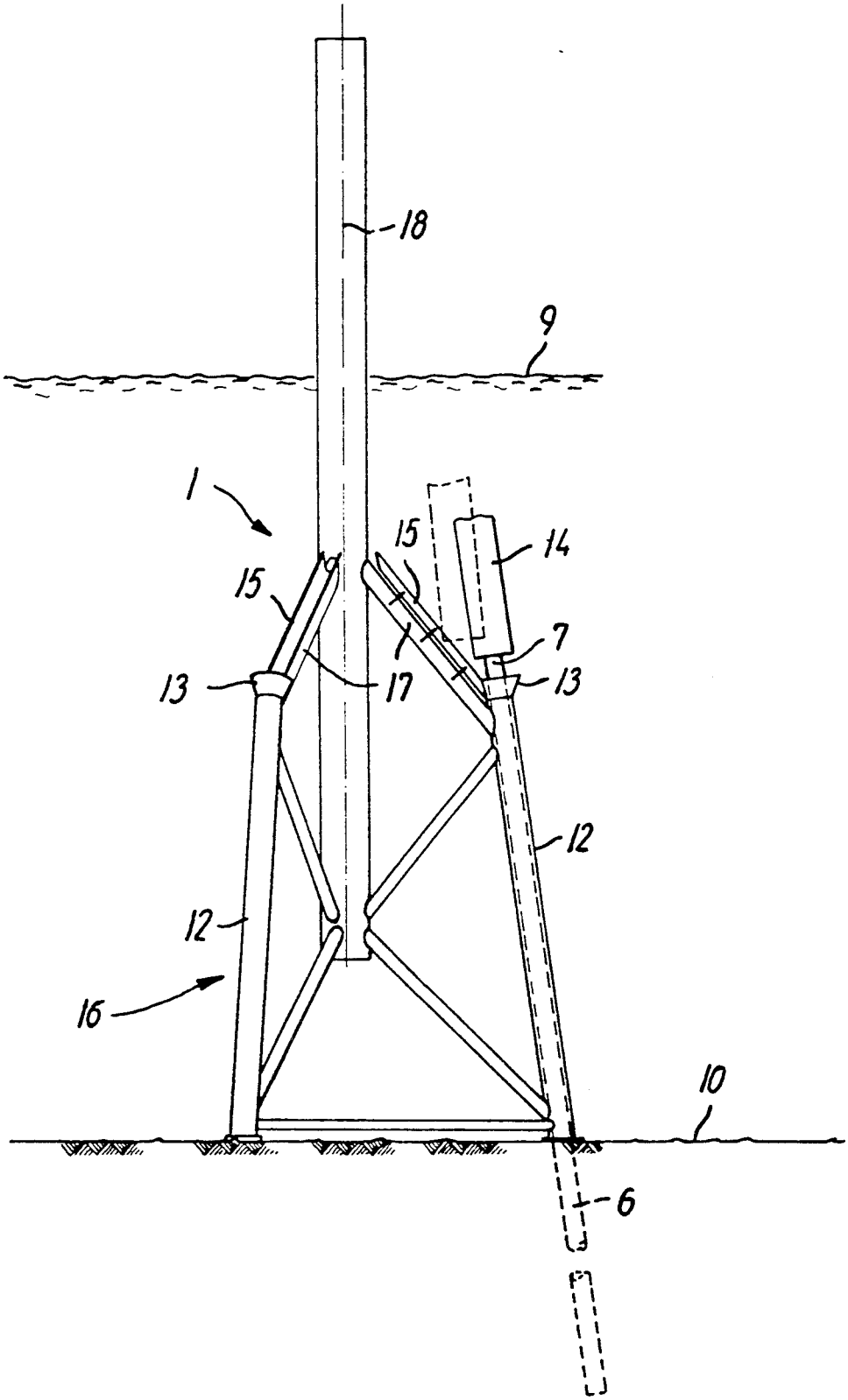
FIG. 9 is a side view of a platform, shown by way of example, having mounted chutes and guides, a foundation pile being provided in one of these.

This is shown best in FIG. 9, which shows a platform 1 to be pinned with three piles. One of these piles 6 has already been placed in the pile guide 12 disposed at the right side of the figure and driven almost down to the final depth in the sea bed 10 by means of a hammer 14. When this operation is completed, the hammer is released from the pile head 7, and during subsequent hoisting the hammer will then, as shown in dotted line, rest against the chute 15 with its lower end and be pulled up said chute by the wire until it hangs steadily and freely downwardly in the vertical (not shown) of the wire. This ensures completely that the hammer will not swing into the platform like a powerful pendulum and damage it when the engagement with the pile head is released.

As appears from the foregoing, all operations in connection with mounting and installation of in particular smaller off-shore platforms on the sea bed may thus be performed according to the invention by means of the drilling rig which is usually already present at the drilling location, and this provides great savings in terms of economy and frequently also in terms of time.

In the preferred embodiment shown in FIGS. 10, 11 and 12, the chutes 15 are firmly mounted on the foundation of the platform, there being then a chute for each pile guide so that the installation operations can be initiated as soon as the platform has been positioned on the sea bed. However, the chute may also be so arranged as to be detachably mountable on the foundation of the platform, and in this case the same chute may be used for mounting many piles, and the chute or the chutes may moreover also be arranged on an entirely different structure which is located at the platform so that the method and the device of the invention may also be used for installation of platforms which are not provided with chutes.

Preferred embodiments of the invention are described in the foregoing and shown in the drawing, but these are merely by way of example. Thus, many other embodiments are conceivable within the scope of the claims. For example, the pile tip and the lower end of the drive means may be controlled and guided by wire drives instead of by the chute.

I claim:

1. A method of mounting piles to a pile-founded offshore platform comprising the steps of:

hoisting the piles, one by one, by a winch on a derrick of a drilling rig, the drilling rig being positioned at a drilling location above the platform and a wire connecting the winch to a pile head of the pile so that in the hoisted position the pile hangs freely and is positioned closer to a central axis of the platform than an upper end of an associated pile guide, the pile guide being attached to a foundation of the platform;

lowering the pile unto the platform with a tip of the pile being initially guided obliquely outwardly and downwardly away from the central axis of the foundation towards the upper end of the pile guide until the tip extends into the upper end, and then continuing to lower the pile down through the pile guide to the sea bed;

driving the pile down into the said bed to a desired depth in the sea bed by a drive means which is suspended from the wire of the winch, a lower end of the drive means being initially guided obliquely inwardly and upwardly towards the central axis of the foundation during the subsequent hoisting of the drive means until the drive means hangs freely downwardly in a generally upright direction.

2. The method according to claim 1, wherein during lowering of the pile the pile tip is slidably guided along a chute which extends from they upper end of the pile guide to a location below the position which the pile tip assumes when the pile is in the freely hanging position.

3. The method according to claim 1, wherein he drive means is hoisted by the winch to a suitable position which is substantially vertically above the pile had of the pile to be driven down into the pile guide, and that the drive means is then lowered to engage the pile head and drive down the pile into the sea bed, following which the dive means is against hoisted and a lower end of the drive means is initially guided slidingly up the chute during movement of the drive means until the drive means hangs freely downwardly in a substantially upright direction.

4. The method according to claim 2, wherein the chute has a C-shaped cross section.

5. The method according to claim 2, wherein the chute has a U-shaped cross section.

6. A device for mounting piles on a pile-founded offshore platform having a foundation and pile guides attached thereto, comprising:

a winch, arranged in connection with a derrick on a drilling rig positioned at a drilling location, connectable to a pile head on the pile by a wire so that the piles can be moved by the pile head, one by one, to a suitable first location above the platform, so that the pile hangs freely and is positioned closer to a central axis of the platform than an upper end of the associated pile guide, to a second location in which the pile is lowered through the pile guide to the sea bed;

drive mean, which is suspended in the wire of the winch, for driving the pile down into the sea bed; and at least one chute for guiding the pile and the drive means in an oblique direction to said central axis, said chute being inclined and extending upwardly from the upper end of a pile guide to a location below a position which a pile tip of the pile assumes when the pile is in said freely hanging position.

7. The device according to claim 6, wherein the chute has an angle of inclination of between 20° and 70° with respect a horizontal plane.

8. The device according to claim 6, wherein the chute is firmly mounted on the platform.

9. The device according to claim 6, wherein in that the chute is detachably mounted on the platform.

10. The device according to claim 6, wherein the chute is mounted on the drilling rig.

11. A device according to claim 6, wherein the chute has a C-shaped cross section.

12. A device according to claim 6, wherein the chute has a U-shaped cross section.

* * * * *